US005667466A

United States Patent [19]

Riley, Jr.

[11] Patent Number: 5,667,466

[45] Date of Patent: Sep. 16, 1997

[54] WRIST OR ANKLE EXERCISE WEIGHT

[76] Inventor: John L. Riley, Jr., 2056 W. 12th St., Jacksonville, Fla. 32209

[21] Appl. No.: 506,538

[22] Filed: Jul. 25, 1995

[51] Int. Cl.[6] ..... A63B 21/065

[52] U.S. Cl. ..... 482/105; 482/44; 482/79; 482/139

[58] Field of Search ..... 482/44, 74, 92, 482/93, 105, 139, 79; D21/198; 473/59

[56] References Cited

U.S. PATENT DOCUMENTS

| | | | |
|---|---|---|---|
| 2,241,833 | 5/1941 | Waller | 482/105 |
| 3,149,839 | 9/1964 | Materia | 482/105 |
| 3,278,184 | 10/1966 | Rosenbaum | 482/105 |
| 3,406,968 | 10/1968 | Mason . | |
| 3,427,020 | 2/1969 | Montour et al. | 482/105 |
| 4,034,979 | 7/1977 | Wester | 473/59 |
| 4,247,097 | 1/1981 | Schwartz . | |
| 4,322,072 | 3/1982 | White . | |
| 4,384,714 | 5/1983 | Kimura | 482/105 |
| 4,556,215 | 12/1985 | Tarbox et al. . | |
| 4,575,075 | 3/1986 | Tarbox et al. . | |
| 4,623,143 | 11/1986 | Wuellenweber | 482/105 |
| 4,700,943 | 10/1987 | Widinski et al. | 482/79 |
| 4,905,991 | 3/1990 | Alston | 482/105 |
| 5,004,227 | 4/1991 | Hoffman . | |
| 5,169,371 | 12/1992 | Holmes . | |
| 5,300,000 | 4/1994 | Schwartz . | |

*Primary Examiner*—Lynne A. Reichard
*Assistant Examiner*—Victor K. Hwang
*Attorney, Agent, or Firm*—Randy W. Lacasse

[57] ABSTRACT

An adjustable weighted exercise sleeve that fits over the hand or foot and is secured thereto enabling the user to accomplish various exercises with the benefit of weight resistance. The adjustable weighted exercise sleeve has adjustable straps secured by hook and loop fasteners to provide a comfortable fit for the user. The configuration of the exercise sleeve and adjustable straps allows the user to interchangeably wear the exercise sleeve on the hand and wrist or foot and ankle. The exercise sleeve uses variable weighting arrangements to allow the user to choose a weight resistance for optimum comfort and physiological benefit.

13 Claims, 3 Drawing Sheets

WRIST OR ANKLE EXERCISE WEIGHT

BACKGROUND OF THE INVENTION

1. Field of Invention

The field of the invention relates, in general, to an exercise sleeve containing weights to provide weight resistance for a user to increase the benefits of exercise. More particularly, the exercise sleeve is adjustable and can be interchangeably worn on either the hand and wrist area or the foot and ankle area.

2. Discussion of Prior Art

In today's health conscious society, the benefits of regular, moderate exercise are almost universally recognized. One of the most popular and effective forms of exercise is training utilizing weight resistance. This type of training can be pure weight training such as using barbells and other very heavy weights to provide weight resistance. Another form of weight training combines aspects of aerobic exercise with moderate weight resistance. It is this second form of aerobic exercise combined with moderate weight resistance for which the present invention is particularly suited.

Various types of aerobic training combined with moderate weight resistance are exercise regimens as follows: walking or jogging combined with ankle or wrist weights; step aerobics with ankle or wrist weights; swimming with hand weights; bicycling with ankle weights. Almost any form of aerobic exercise can be combined with ankle or wrist weights to increase the benefits of the exercise.

In view of the fact that aerobic training with moderate weight resistance is such a popular and beneficial exercise regimen, there exists a need for an adjustable exercise sleeve that can be worn on either the hand and wrist or foot and ankle area of the user. The present invention provides for a weighted adjustable exercise sleeve that can easily be worn on the hand and wrist area or quickly converted for use on the foot and ankle area of the user.

The prior art has heretofore afforded various apparatuses to provide moderate weight resistance for the foot or hand. However, these apparatus are specifically designed for either the foot or hand area. The present invention is distinct because it is specifically designed to be adjustable so that it can be interchangeably worn on either the hand and wrist area or the foot and ankle area.

Prior art examples of weight resistance apparatuses are discussed below.

The patents to Tarbox et al. (U.S. Pat. Nos. 4,556,215 and 4,575,075) provide for a weighted hand exercise sleeve including an opening through which the thumb is inserted when the sleeve is secured to the hand.

The patents to Schwartz (U.S. Pat. Nos. 4,247,097 and 5,300,000) provide for exercise sleeves for the hand and wrist that have removable weights in pockets on the outside of the sleeve.

The patent to Holmes (U.S. Pat. No. 5,169,371) provides for a weighted glove fastened to the hand by hook and loop material or straps with buckles.

The patent to Hoffman (U.S. Pat. 5,004,227) provides for an exercise apparatus for strapping weights to a user's hand for swimming or jogging.

The patent to White (U.S. Pat. No. 4,322,072) provides for an exercise apparatus for attachment to a foot that includes pockets for receiving weights.

The patent to Mason (U.S. Pat. No. 3,406,968) provides for an isometric exercise boot with weighted pockets.

The prior art does provide for various weighted exercise sleeve apparatuses for either the hand and wrist area or the foot and ankle area. However, none of the prior art apparatuses provides for an exercise sleeve that can be adjusted and interchangeably worn on either the hand and wrist area or the foot and ankle area as per the present invention.

It is common in the prior art to include various means to secure weighted exercise sleeves to the user including straps, hook and loop fasteners and other similar securing means. However, these securing means are designed with specific configurations which provide attachment to the hand and wrist area or the foot and ankle area but not both. The present invention is distinguishable from the prior art because the exercise sleeve can be interchangeably worn on either the hand and wrist area or the foot and ankle area and the securing means of the present invention is adjustable so that the exercise sleeve will have a proper, comfortable fit in either arrangement.

The prior art provides for various types of weights that can be used for exercise sleeve apparatuses including lead shot, metals or other materials. The present invention utilizes these and other types of weights.

The prior art does provide for reclosable weight pockets for exercise sleeves wherein the closure means are hook and loop fasteners, zippers, straps and other devices. The present invention utilizes these and other closure means to reclose the weight pockets.

SUMMARY OF THE INVENTION

As shown by the prior art, there exists a need for an adjustable weighted exercise sleeve that can be interchangeably worn on either the hand and wrist area or the foot and ankle area.

It is therefore an object of the invention to provide an adjustable weighted exercise sleeve that can be interchangeably worn on either the hand and wrist area or the foot and ankle area.

It is another object of the invention to provide for an adjustable securing means that can be arranged to secure a proper, comfortable fit for the weighted exercise sleeve on either the hand and wrist area or the foot and ankle area.

It is another object of the invention to provide for an adjustable weighted exercise sleeve that can be interchangeably worn on either the hand and wrist area or the foot and ankle area wherein the amount of weight in the exercise sleeve can be varied by increasing or decreasing the number of weighted pockets of material.

It is another object of this invention to provide for an adjustable weighted exercise sleeve that can be interchangeably worn on either the hand and wrist area or the foot and ankle area wherein the pockets containing the weight materials are reclosable so that weights can be inserted or removed as desired by the user.

The instant invention solves the aforementioned problem by providing an adjustable weighted exercise sleeve that can be interchangeably worn on either the hand and wrist area or the foot and ankle area.

These and other objects of the invention will become evident when taken in conjunction with the drawings, claims and description of the preferred embodiments of the invention.

DESCRIPTION OF THE PREFERRED EMBODIMENTS

Figure 1:
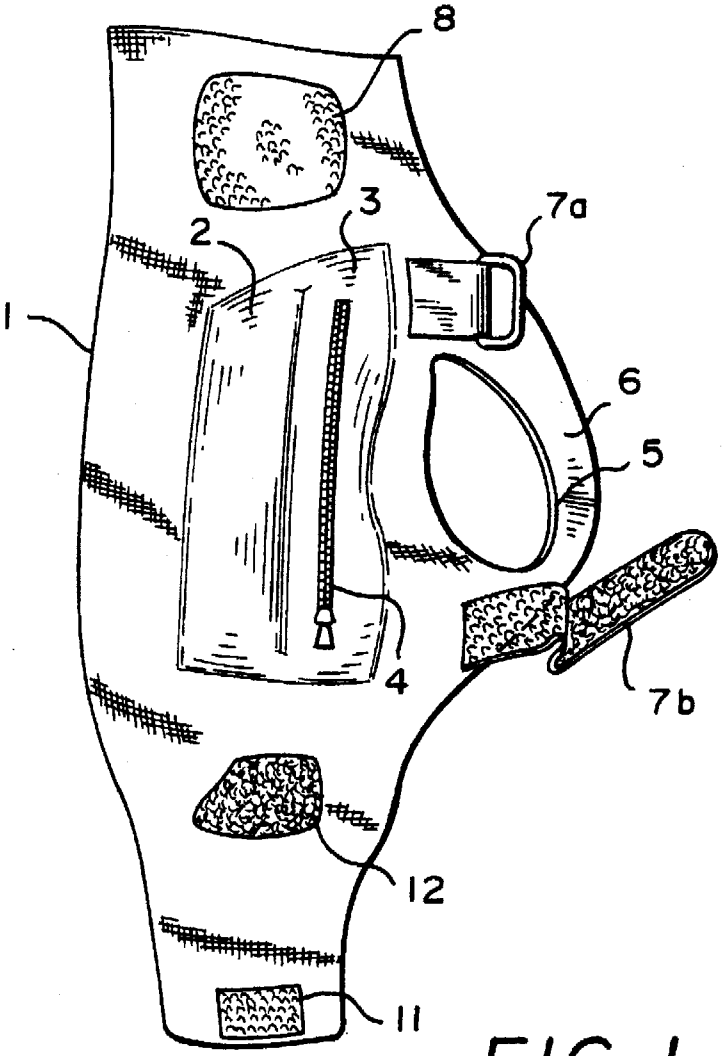
FIG. 1 illustrates an external view of the preferred embodiment in an unattached and open position.

FIG. 1 illustrates the preferred embodiment of the present invention comprising an exercise sleeve 1 in an open position and lying flat. The exercise sleeve 1 is constructed of a durable flexible, water resistant material that can be readily secured to the hand and wrist area or foot and ankle area of a user. The exercise sleeve 1 can be made of any durable, flexible, expansible, water resistant material such as neoprene, rubber, nylon, LYCRA®, SPANDEX®, terry cloth, elastic, cotton, plastic or combinations of the above materials. The invention should not be limited to the above listed materials but may be interchanged with comparable materials.

The exercise sleeve 1 has weight pockets 2 and 3 on the outside of sleeve 1 that contain weight materials. The weight materials can be lead shot, lead beads, lead pellets, clay, water, gel substances, metal pellets, metal shavings, metal bars, metal ingots, plastic or combinations of the above materials or equivalents thereof.

Fixed weight pocket 2 is factory sealed and contains a predetermined amount of weight material. Weight pocket 3 is shown in an alternative embodiment with a weight varying opening. Weight pocket 3 is reclosable by reclosing member 4. Reclosing member 4 can be hook and loop fastener (VELCRO®), zippers (as shown), clamps (metal, plastic or other), clips (metal, plastic or other), tied fabric or combinations of the above reclosing members. Variable weight pocket 3 has a reclosing member 4 so that the user of the exercise sleeve 1 can increase or decrease weight resistance by adding to or subtracting weight materials from the variable weight pocket 3. Thus, the user of the sleeve 1 can customize the weight resistance to suit his particular needs.

Figure 2:
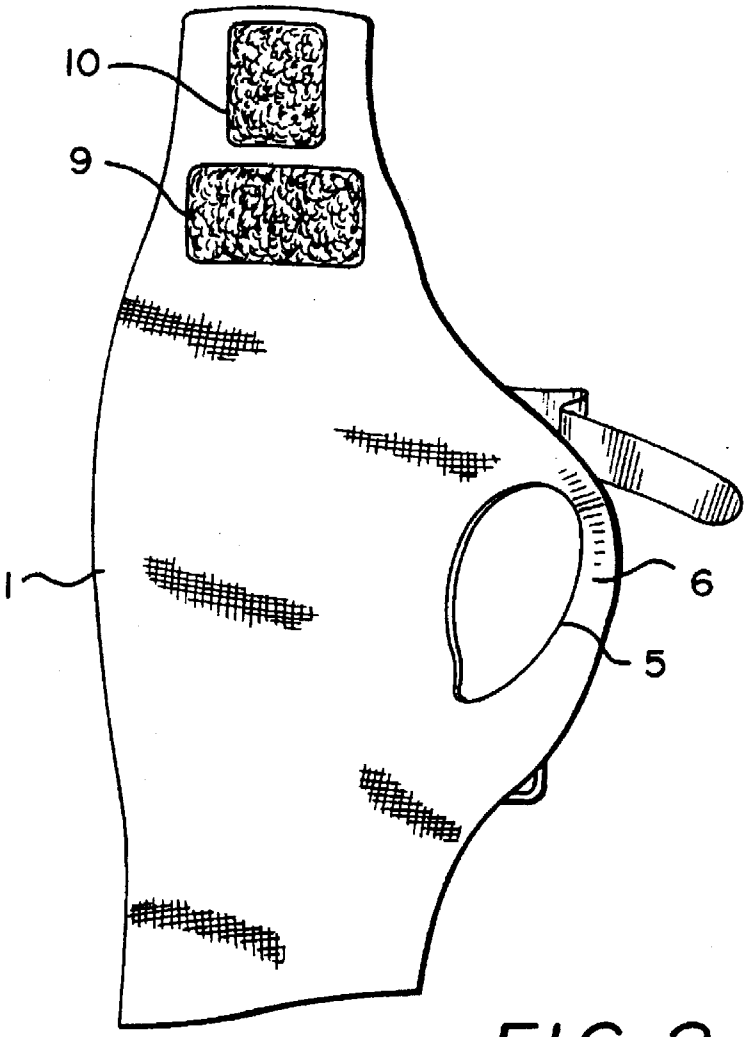
FIG. 2 illustrates an inside view of the configuration of FIG. 1.

FIG. 2 illustrates the reverse side of the preferred embodiment as shown in FIG. 1. Exercise sleeve 1 is secured to the user by wrapping sleeve 1 around the area for which weight resistance is desired. Sleeve 1 has a securing means 8 comprising a hook and loop fastener (VELCRO®) patch on the outside of the sleeve. Sleeve 1 has securing means 9, 10 on the inside of sleeve 1. Securing means 9, 10 comprise patches of hook and loop fastener (VELCRO®) on the inside of sleeve 1.

Figure 3A:
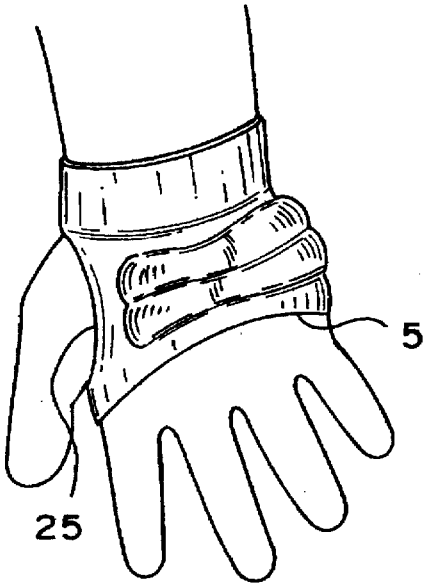
FIG. 3*a* illustrates the invention, as shown in FIGS. 1 and 2, secured to the hand and wrist area of a user.
Figure 3B:
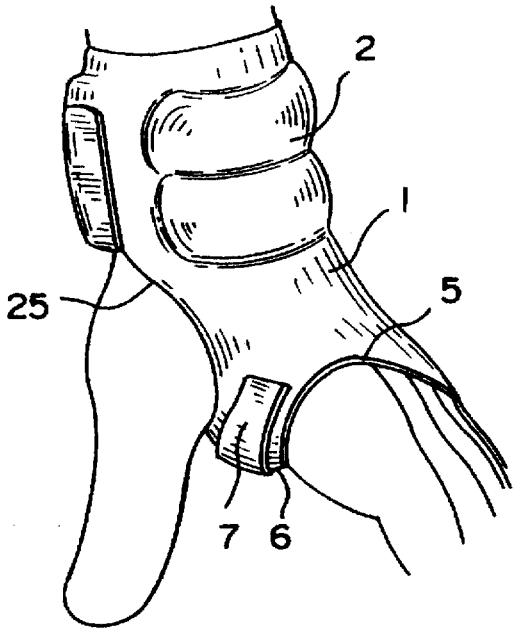
FIG. 3*b* illustrates the invention secured to the hand and wrist area of a user with the weights shifted towards the wrist area.

FIGS. 3*a* and 3*b* illustrate the exercise sleeve attached to a user's hand. Sleeve 1 has an opening 5 through which the user's fingers are placed. Opening 5 is surrounded by the main body of sleeve 1 and the stirrup stabilizer band 6. The stirrup stabilizer band 6 is the part of sleeve 1 that positions sleeve 1 in a proper manner on the user's body. After sleeve 1 is wrapped around a user's hand and wrist area, securing means 9 on the inside of sleeve 1 is attached to securing means 8 on the outside of the sleeve 1. Opening 25 is formed upon connecting securing means 8 to securing means 9 for the purpose of retaining the user's thumb. By proper alignment the apparatus will fit securely around the wrist area. The stirrup stabilizer band 6 has a tension adjustment strap assembly 7*a*, with buckle and strap 7*b* which can be fed through the buckle and folded back against an opposing VELCRO® receiving section so that band 6 can be tightened or loosened to secure a proper fit through the thumb webbing area.

As discussed above, when the invention is used with the hand and wrist area, securing means 9 is attached to securing means 8. Used in this manner, the sleeve 1 would have an extra portion of the sleeve 1 where securing means 10 is located hanging unattached to any other part of sleeve 1. In order to secure this portion of sleeve 1, a hook and loop fastener (VELCRO®) patch 11 is placed on the outside of sleeve 1 opposite securing means 10. Hook and loop fastener (VELCRO®) patch 11 is then folded back to come into contact with hook and loop fastener (VELCRO®) patch 12 to secure this portion of sleeve 1.

FIG. 3*b* shows the invention with a slightly lengthened wrist section and has the weights 2 and 3 shifted to the wrist area.

Figure 3C:
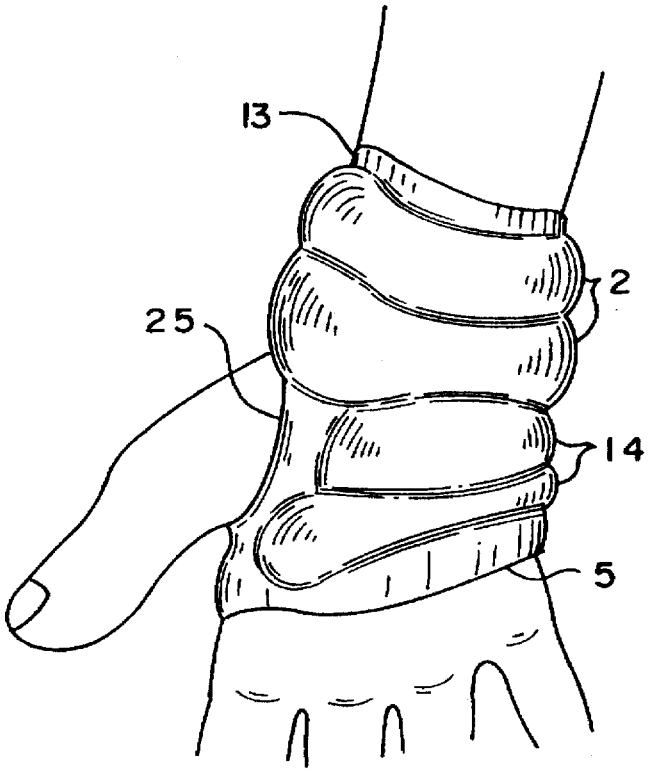
FIG. 3*c* illustrates the invention with weights located both on the hand and wrist sections.

FIG. 3*c* illustrates a combination of embodiments 3*a* and 3*b* with weights 2 and 14 located on both the hand and wrist with extended wrist section 13.

Figure 3D:
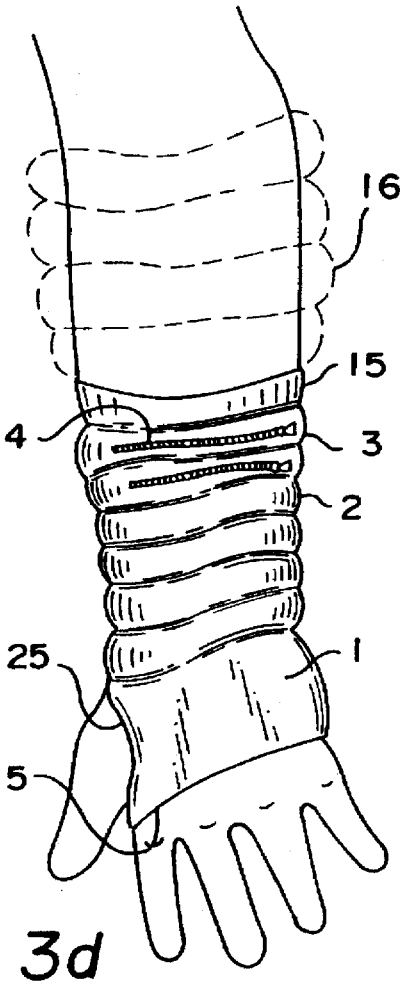
FIG. 3*d* illustrates the invention with a longer wrist section with additional weighting sections.

FIG. 3*d* illustrates an extended wrist section 15 with many weights 16 but with no hand section weights as shown originally by elements 2 and 3 of FIGS. 1 and 2, etc. The wrist section may contain weight varying openings as per original element 4.

Figure 4A:
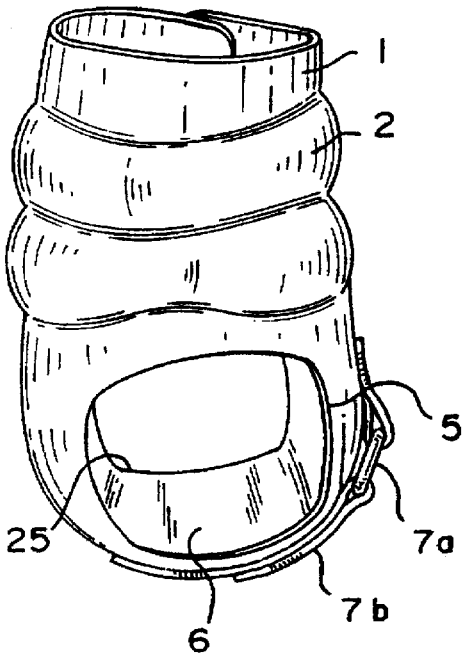
FIG. 4*a* illustrates a front view of the invention as it would be configured to be secured to the foot and ankle area of a user.
Figure 4B:
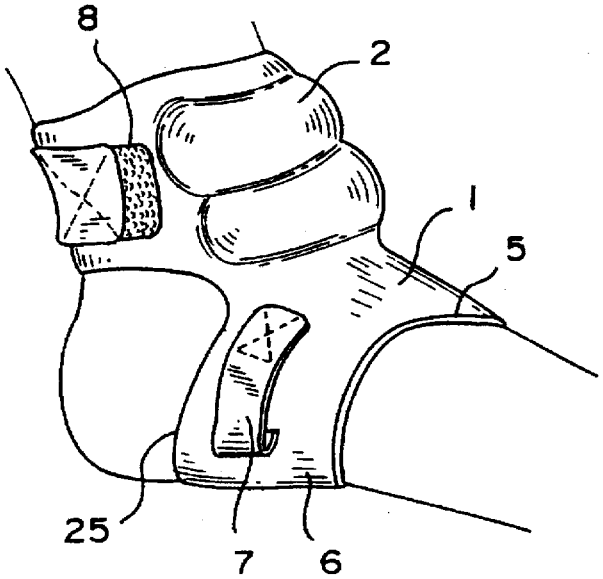
FIG. 4*b* illustrates a side view of the invention secured to the foot and ankle area of a user.

FIGS. 4*a*–4*d* illustrate various embodiments of the invention when attached to the foot and ankle area. In the preferred embodiment, the configuration as shown in FIGS. 1, 2 and 3*a* is now secured as shown in FIGS. 4*a* or 4*b*.

The user places the toes of his foot through opening 5 so that band 6 is around the heel/arch area. Tension adjustment strap assembly 7*a* and 7*b* can be attached to band 6 (FIG. 4*a*) or may be reversed and folded back without threading through the buckle of 7*a* as shown in FIG. 4*b*. Strap 7 is adjustable in order to tighten or loosen band 6 to properly fit the user.

When sleeve 1 is wrapped around user's foot and ankle area, hook and loop fastener (VELCRO®) securing means 10 on the inside of sleeve 1 is attached to hook and loop fastener (VELCRO®) receiving means 8 on the inside of the sleeve 1. Hook and loop fastener (VELCRO®) securing means 9 is located closer to the center of sleeve 1 than securing means 10 and can be used for a user with a small diameter ankle area. As in the above discussion with respect to extra material, the hook and loop fastener (VELCRO®) patch 11 is then folded back to come into contact with hook and loop fastener (VELCRO®) patch 12 to secure this portion of sleeve 1.

Figure 4C:
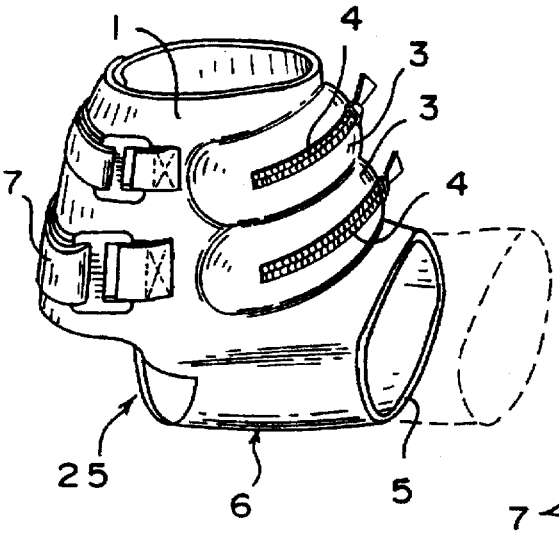
FIG. 4*c* illustrates a side view of alternative embodiment of the invention as it would appear secured to foot and ankle area of a user with adjustable weight enclosures.

FIG. 4*c* illustrates a side view of an alternative embodiment of the invention as it would appear secured to foot and ankle area of a user with adjustable weight enclosures.

Figure 4D:
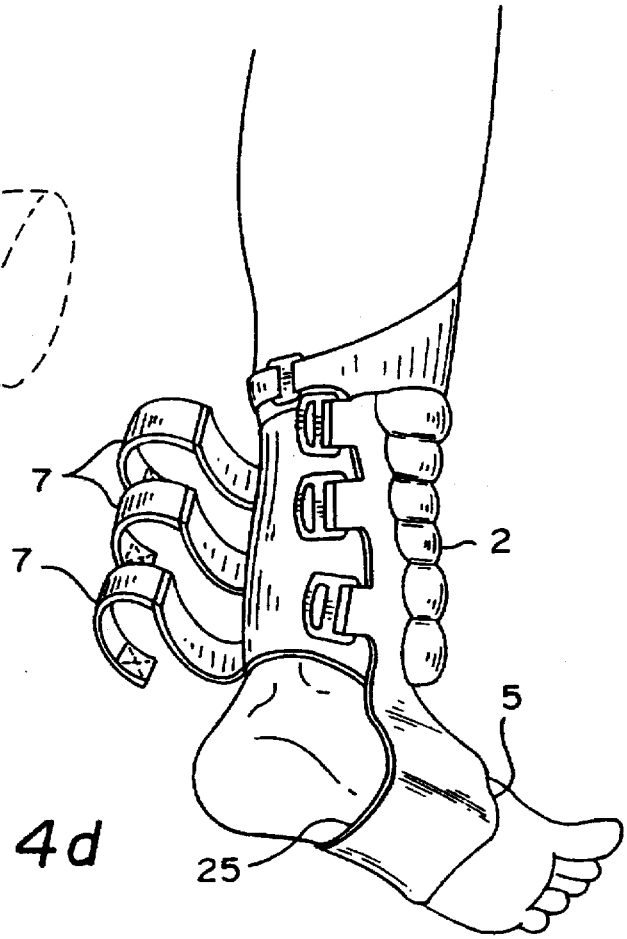
FIG. 4*d* illustrates an alternative embodiment of the invention secured to the foot and ankle area of a user with an extended ankle/shin section and additional weight sections thereon.

FIG. 4*d* illustrates an alternative embodiment of the invention secured to the foot and ankle area of a user with an extended ankle/shin section and additional weight sections thereon.

CONCLUSION

A system and method has been shown in the above embodiments for the effective implementation of an adjustable weighted exercise sleeve that can be interchangeably worn on either the hand and wrist area or the foot and ankle area of a user. While various preferred embodiments have been shown and described, it will be understood that there is no intent to limit the invention by such disclosure, but rather, it is intended to cover all modifications and alternate constructions falling within the spirit and scope of the invention as defined in the appended claims. The invention should not be limited by size, shape and/or materials. In addition, the weight materials, securing means and reclosable members may be of any known type in the art that accomplishes the desired purpose. Sleeve 1 can be varied in size to accommodate numerous weight pockets and any combination of fixed weight pockets 2 and variable weight pockets 3.

I claim:

1. An interchangeable weighted exercise sleeve worn in a first configuration on the hand/wrist area and in a second configuration on the foot/ankle area of a user comprising:

a flexible sleeve member having a first and second end, said flexible sleeve member having an enlarged center section between said first and second ends;

an expansible opening integrally contained within said flexible sleeve member and located within a distal section of said enlarged center section;

a strap and buckle tensioning means attached to said distal section of said enlarged center section for adjusting the size of said expansible opening;

a plurality of securing means located on said flexible sleeve member for circumferentially securing said first end to said second end of said flexible sleeve member;

at least one weighted pocket located on said flexible sleeve, and wherein in said first configuration, said expansible opening is adapted to receive fingers of said user and said circumferential securing is adapted to retain the hand/wrist area of the user and in a second configuration, said expansible opening is adapted to receive the toes of said user and said circumferential securing is adapted to retain the foot/ankle of the user.

2. An interchangeable weighted exercise sleeve worn in a first configuration on the hand/wrist area and in a second configuration on the foot/ankle area of a user as per claim 1, wherein said weighted pockets are sealed.

3. An interchangeable weighted exercise sleeve worn in a first configuration on the hand/wrist area and in a second configuration on the foot/ankle area of a user as per claim 1, wherein at least one of said weighted pockets is reclosable.

4. An interchangeable weighted exercise sleeve worn in a first configuration on the hand/wrist area and in a second configuration on the foot/ankle area of a user as per claim 1, wherein said plurality of securing means comprises hook and loop fasteners.

5. An interchangeable weighted exercise sleeve worn in a first configuration on the hand/wrist area and in a second configuration on the foot/ankle area of a user as per claim 1, wherein said weighted pockets are variable in size and number.

6. An interchangeable weighted exercise sleeve worn in a first configuration on the hand/wrist area and in a second configuration on the foot/ankle area of a user as per claim 1, wherein said flexible sleeve member is enlarged to accommodate additional weights.

7. An interchangeable weighted exercise sleeve worn in a first configuration on the hand/wrist area and in a second configuration on the foot/ankle area of a user as per claim 1, wherein said flexible sleeve member is comprised of neoprene rubber.

8. An interchangeable weighted exercise sleeve configurable in a first configuration to provide weighted exercise resistance to a user's arms and in a second configuration, to a user's legs comprising:

an elongated flexible band having a first and second end;

said flexible band having an enlarged center section located between said first and second ends, said flexible band being tapered from said enlarged center section towards each of said first and second ends;

hook and loop fastening means located on said first and second ends for securing said flexible band in a sleeve configuration;

an expansible opening integrally contained within a distal section of said enlarged center section;

a strap and buckle attached to said distal section of said enlarged center section for adjusting the size of said expansible opening;

at least one weighted section located within said flexible band;

wherein in a first configuration, said expansible opening is adapted to receive and retain fingers of said user and said sleeve is adapted to separately retain a thumb and wrist of said user and in a second configuration said expansible opening is adapted to receive and retain toes of the user and said sleeve is adapted to separately retain a heel and ankle of the user.

9. An interchangeable weighted exercise sleeve configurable in a first configuration to provide weighted exercise resistance to a user's arms and in a second configuration, to a user's legs as per claim 8, wherein said weighted sections are sealed.

10. An interchangeable weighted exercise sleeve configurable in a first configuration to provide weighted exercise resistance to a user's arms and in a second configuration, to a user's legs as per claim 8, wherein at least one of said weighted sections are reclosable.

11. An interchangeable weighted exercise sleeve configurable in a first configuration to provide weighted exercise resistance to a user's arms and in a second configuration, to a user's legs as per claim 8, wherein said weighted sections are variable in size, number and location.

12. An interchangeable weighted exercise sleeve configurable in a first configuration to provide weighted exercise resistance to a user's arms and in a second configuration, to a user's legs as per claim 8, wherein said flexible band is enlarged to accommodate additional weighted sections.

13. An interchangeable weighted exercise sleeve configurable in a first configuration to provide weighted exercise resistance to a user's arms and in a second configuration, to a user's legs as per claim 8, wherein said elongated flexible band is comprised of neoprene rubber.

* * * * *